US006535185B2

(12) United States Patent
Kim et al.

(10) Patent No.: US 6,535,185 B2
(45) Date of Patent: Mar. 18, 2003

(54) ACTIVE DRIVING CIRCUIT FOR DISPLAY PANEL

(75) Inventors: Hak Su Kim, Seoul (KR); Oh Kyong Kwon, Seoul (KR); Young Sun Na, Seoul (KR)

(73) Assignee: LG Electronics Inc., Seoul (KR)

( * ) Notice: Subject to any disclaimer, the term of this patent is extended or adjusted under 35 U.S.C. 154(b) by 197 days.

(21) Appl. No.: 09/797,957

(22) Filed: Mar. 5, 2001

(65) Prior Publication Data

US 2001/0019327 A1 Sep. 6, 2001

(30) Foreign Application Priority Data

Mar. 6, 2000 (KR) ..... 2000-11056

(51) Int. Cl.[7] ..... G09G 3/30

(52) U.S. Cl. ..... 345/76; 345/30; 345/33; 345/36; 345/44; 345/45; 345/55; 345/204; 345/211; 315/169.1; 315/169.3; 315/169.4

(58) Field of Search ..... 345/45, 76, 30, 345/33, 36, 44, 55, 204, 211; 315/169.1, 169.3, 169.4

(56) References Cited

U.S. PATENT DOCUMENTS 6,023,259 A 2/2000 Howard et al. ..... 345/76
6,091,203 A 7/2000 Kawashima et al. ..... 315/169.3
6,229,506 B1 * 5/2001 Dawson et al. ..... 345/82

FOREIGN PATENT DOCUMENTS

| | | |
|---|---|---|
| EP | 1 003 150 A1 | 5/2000 |
| JP | 11282419 A | 10/1999 |
| WO | WO 99/48078 | 9/1999 |
| WO | WO 99/65012 | 12/1999 |

* cited by examiner

*Primary Examiner*—Richard Hjerpe
*Assistant Examiner*—Jean Lesperance
(74) *Attorney, Agent, or Firm*—Fleshner & Kim, LLP

(57) ABSTRACT

An active driving circuit for a display panel includes first to fourth transistors, a capacitor, a constant current source, and a capacitor. The first transistor is connected with a positive power source. The second transistor has a common gate terminal together with the first transistor and a mirror circuit against the first transistor. Also, the second transistor is turned on by a common gate signal applied to the common gate terminal to supply the positive power source to a display device. The third transistor sets a saturated threshold voltage for the common gate terminal by allowing the first transistor and the second transistor to constitute a mirror circuit against each other in accordance with a scan line signal. The constant current source supplies a current with a ground one side and controlled by a gray signal of a data line. The fourth transistor sets the common gate voltage corresponding to the controlled current of the constant current source by the scan line signal. The capacitor accumulates charges corresponding to the difference between the positive power source and the common gate voltage.

9 Claims, 3 Drawing Sheets

ACTIVE DRIVING CIRCUIT FOR DISPLAY PANEL

BACKGROUND OF THE INVENTION

1. Field of the Invention

The present invention relates to an active driving circuit for a display panel.

2. Description of the Related Art

Recently, the field of flat displays is rapidly developing. Flat display devices that started to develop based on a liquid crystal display (LCD) have been ahead of a cathode ray tube (CRT) mostly used for several decades in the display field.

Various display devices such as a plasma display panel (PDP), a visual fluorescent display (VFD), a field emission display (FED), a light emitting diode (LED), and electroluminescence (EL) have been recently developed.

A driving method of the above display devices is divided into a passive driving method and an active driving method. The passive driving method is based on a simple matrix while the active driving method is based on a thin film transistor (TFT) LCD.

However, the simple matrix display device is driven by a scan driving method, and scan time that can drive the display device is limited. To obtain desired luminance, a high voltage is required. This gives an adverse effect to life span of the display device.

A driving circuit for the TFT-LCD applies a data line signal and a scan line signal to a liquid crystal panel having a driving circuit arranged in a crossing point of a gate line and data lines, thereby driving each pixel.

Each pixel includes a plurality of TFTs, a memory capacitor, and a display device. The TFTs are connected with the scan line and the data line. The memory capacitor and the display device are respectively connected with common terminals of the TFTs in parallel.

The transistors are used for switching and driving functions in accordance with signals applied from the scan line and the data line, so that a voltage is stored in the capacitor and the display device is driven by the stored voltage.

An active driving circuit for the aforementioned display panel will be described with reference to the accompanying drawings.

FIG. 1 is a diagram showing a related art active driving circuit for a display panel based on two active devices.

As shown in FIG. 1, two active devices, PMOS transistors Q2 and Q3 are arranged within each pixel.

Meanwhile, a constant positive voltage is applied to the PMOS transistor Q3 through the data line. In applying a voltage of the data line to a charge storage capacitor Cch within the driving circuit and the PMOS transistor Q2, the scan line controls the PMOS transistor Q3 that acts as a switch.

In more detail, the related art driving circuit includes a PMOS transistor Q2 connected with a positive power source Vdd, the charge storage capacitor Cch, and a display device such as opto electro luminescence (OEL) to directly drive the OEL. The charge storage capacitor Cch is connected to the positive power source Vdd.

Meanwhile, an anode of the OEL is connected with the driving PMOS transistor Q2 and its cathode is connected with a negative power source Vss.

The operation of the aforementioned related art active driving circuit for display panel will be described below.

If a gray voltage is applied from the data line, the gray voltage is input to the charge storage capacitor Cch and a control terminal of the driving PMOS transistor Q2, i.e., a gate, through the switching PMOS transistor Q3.

A current corresponding to a positive voltage of the capacitor Cch is supplied to the OEL through the driving PMOS transistor Q2. Brightness of the OEL is controlled by the data line signal.

Meanwhile, the switching PMOS transistor Q3 is controlled by the scan line signal.

As described above, brightness of each pixel is controlled by a voltage from the data line. Respective pixels constitute one screen.

However, the related art driving circuit for a display panel has several problems.

First, if a deviation occurs in a threshold voltage of the driving PMOS transistor, it is difficult to effectively solve the deviation. Moreover, even if the deviation can be controlled, the deviation should be measured in detail for compensation.

Furthermore, if a deviation occurs in the charge storage capacitor, a problem arises in that it is difficult to solve the deviation.

SUMMARY OF THE INVENTION

To solve the above problems, an object of the present invention is to provide an active driving circuit for a display panel in which a deviation of a threshold voltage can automatically be compensated.

Another object of the present invention is to provide an active driving circuit for a display panel in which a deviation of a threshold voltage of a transistor for driving a display panel can be minimized.

Other object of the present invention is to provide an active driving circuit for a display panel in which a display device can stably be operated.

To achieve the above object, an active driving circuit for a display panel according to one aspect of the present invention includes a first transistor connected with a positive power source and a second transistor constituting a mirror circuit against the first transistor. The second transistor has a common gate terminal together with the first transistor and is turned on by a common gate signal applied to the common gate terminal to supply the positive power source to a display device.

The active driving circuit for a display panel according to the present invention further includes a third transistor, a constant current source, a capacitor, and a fourth transistor. The third transistor sets a saturated threshold voltage for the common gate terminal by allowing the first transistor to act as a diode by a scan line signal. The constant current source supplies a current with a ground one side and controlled by a gray signal of a data line. The fourth transistor is turned on by the scan line signal subsequent to the third transistor and controls a voltage of the common gate terminal corresponding to the controlled current of the constant current source by the scan line signal. The capacitor accumulates charges corresponding to the difference between the positive power source and the common gate voltage.

In the preferred embodiment of the present invention, the first and second transistors constitute a mirror circuit when they are turned on, thereby compensating a deviation of a threshold voltage. The capacitor uniformly accumulates charges in accordance with characteristics of the positive power source and the mirror circuit.

The constant current source supplies the current controlled by the gray signal using a current programming mode to generate a voltage difference in the common gate terminal.

The transistors constituting a mirror circuit are differently fabricated at a constant ratio to control a driving current applied to the display device.

To obtain fast response time and improved luminance, a constant current value is initially applied to the display device, and a voltage control device is used so as not to lower an anode electrode of the display device below a constant voltage.

A driving integrated circuit which includes a constant current source that acts to control a current is additionally provided to compensate a deviation of threshold voltages generated in the transistors.

It is to be understood that both the foregoing general description and the following detailed description are exemplary and explanatory and are intended to provide further explanation of the invention as claimed.

BRIEF DESCRIPTION OF THE DRAWINGS

Other objects, characteristic features and advantages of the present invention will now become apparent with a detailed description of an embodiment made with reference to the accompanying drawings, in which:

FIG. 2B is a diagram showing an active driving circuit when a third PMOS transistor of FIG. 2A is turned on;

FIG. 2C is a diagram showing an active driving circuit when the third PMOS transistor and a fourth PMOS transistor of FIG. 2A are turned on;

DETAILED DESCRIPTION OF THE PREFERRED EMBODIMENTS

The following is a detailed description of a preferred embodiment of an active driving circuit for a display panel according to the present invention made with reference to the accompanying drawings.

Figure 1:
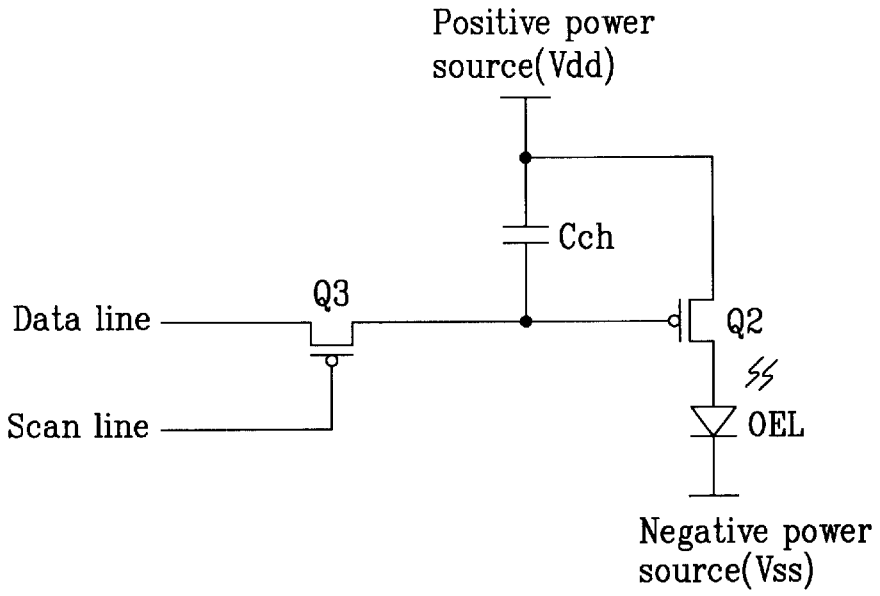
FIG. 1 Related Art
FIG. 1 is a circuit diagram showing a related art driving circuit for a display panel based on two active devices.
Figure 2A:
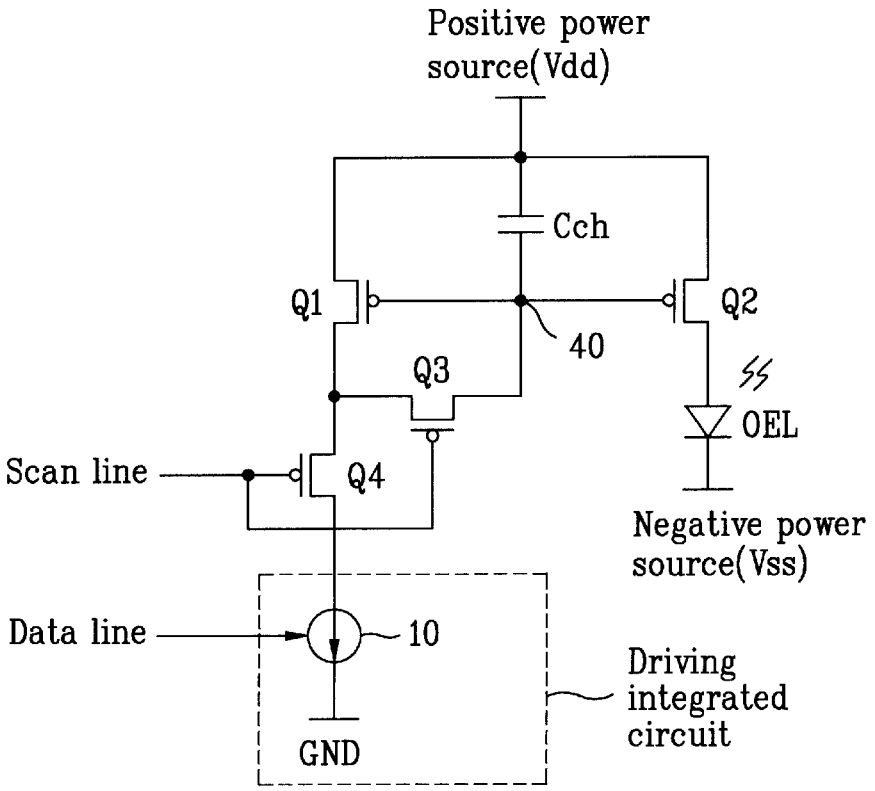
FIG. 2A is a circuit diagram showing a driving circuit for a display panel based on four active devices in accordance with the first embodiment of the present invention.

FIG. 2A is a circuit diagram showing a driving circuit for a display panel based on four active devices in accordance with the first embodiment of the present invention.

Referring to FIG. 2A, the driving circuit includes a positive power source, Vdd, a capacitor Cch, first to fourth PMOS transistors Q1, Q2, Q3, and Q4, an OEL, a constant current source, and a negative power source Vss.

The first PMOS transistor Q1 includes a first signal terminal (source) connected with the positive power source Vdd, a gate, and a second signal terminal (drain).

The second PMOS transistor Q2 includes a gate connected with the gate of the first PMOS transistor Q1, a first signal terminal (source) connected with the positive power source Vdd, and a second signal terminal (drain) connected with the OEL.

The second PMOS transistor Q2 includes a mirror circuit against the first PMOS transistor Q1 and is turned on by a common gate signal applied to its gate so that the positive power source Vdd is supplied to the OEL.

The third PMOS transistor Q3 includes a first signal terminal connected with the second signal terminal of the first PMOS transistor Q1, a second signal terminal connected with the gates of the first and second PMOS transistors Q1 and Q2, and a gate connected with the scan line.

When the third PMOS transistor Q3 is turned on by the scan line signal (low signal), the first PMOS transistor Q1 is operated as a diode. Accordingly, a saturated threshold voltage Vth.Sat. for a common gate terminal of the first and second PMOS transistors Q1 and Q2 is set. At this time, the saturated threshold voltage is obtained by subtracting a voltage value Vgs between the gate and the source of the first PMOS transistor Q1 from a voltage of the positive power source Vdd. Meanwhile, when the third PMOS transistor Q3 is turned off by the scan line signal (high signal), the first PMOS transistor Q1 does not act as a mirror circuit any longer. Accordingly, the capacitor Cch and the second PMOS transistor Q2 only drive the OEL.

The constant current source 10 has a first grounded terminal and a second terminal opposite to the first terminal. The constant current source 10 supplies a current controlled by a gray signal of the data line. That is, the constant current source 10 serves to set a voltage value for controlling the amount of charges accumulated in the capacitor Cch so as to set the gray signal.

The fourth PMOS transistor Q4 includes a first signal terminal connected with the second signal terminal of the first PMOS transistor Q1, a second signal terminal connected with the second terminal of the constant current source 10, and a gate connected with the scan line.

The fourth PMOS transistor Q4 is turned on by the scan line signal (low signal) with certain time difference subsequent to the third PMOS transistor. Accordingly, the common gate voltage corresponding to the controlled current of the constant current source 10 is applied to the gates of the first and second PMOS transistors Q1 and Q2. Meanwhile, when the fourth PMOS transistor Q4 is turned off by the scan line signal (high signal), the first PMOS transistor Q1 does not act as a mirror circuit against the second PMOS transistor Q2.

The capacitor Cch is connected between the positive power source Vdd and the gates of the first and second PMOS transistors Q1 and Q2.

Meanwhile, the capacitor Cch accumulates charges corresponding to the difference between the positive power source Vdd and the common gate voltage applied to the gates of the first and second PMOS transistors Q1 and Q2.

The configuration of FIG. 2A will now be described in more detail.

As described above, the capacitor Cch is connected with the positive power source and accumulates a small amount of charges. Meanwhile, the first PMOS transistor Q1 and the second PMOS transistor Q2 constitute the mirror circuit against each other, and apply a current for the positive power source Vdd to the OEL while they are turned on by the common gate voltage applied to the common gate terminal.

The constant current source 10 controls the size of the common gate voltage applied to the common gate terminal of the first and second PMOS transistors Q1 and Q2 by the gray signal from the data line.

The third and fourth PMOS transistors Q3 and Q4 are sequentially turned on by a scan signal from the scan line at a constant time interval. The current controlled by the constant current source 10 determines a voltage of the common gate terminal 40 of the first and second PMOS transistors Q1 and Q2. Charges are accumulated in the capacitor Cch depending on the controlled current of the constant current source 10.

The positive power source Vdd is connected with source terminals of the first and second PMOS transistors Q1 and Q2. The capacitor Cch is serially connected with the positive power source Vdd and also is serially connected with the common gate terminal 40 of the first and second PMOS transistors Q1 and Q2.

The second PMOS transistor Q2 is connected with an anode of the OEL and the negative power source Vss is connected with a cathode of the OEL.

The first signal terminal of two signal terminals from the third PMOS transistor Q3 is connected with the common gate terminal 40 and the capacitor Cch.

Meanwhile, the first signal terminal of the fourth PMOS transistor Q4 is connected with the drain of the first PMOS transistor Q1 while its second signal terminal is connected with the driving integrated circuit which includes the constant current source.

The constant current source 10 included in the driving integrated circuit is controlled by a current programming mode that acts to control the amount of the current through the gray signal from the data line.

The operation of the active driving circuit shown in FIG. 2A will be described with reference to FIGS. 2B to 2D.

Figure 2B:
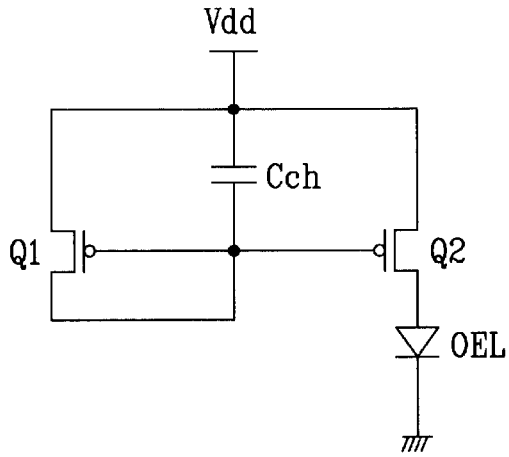
Figure 2C:
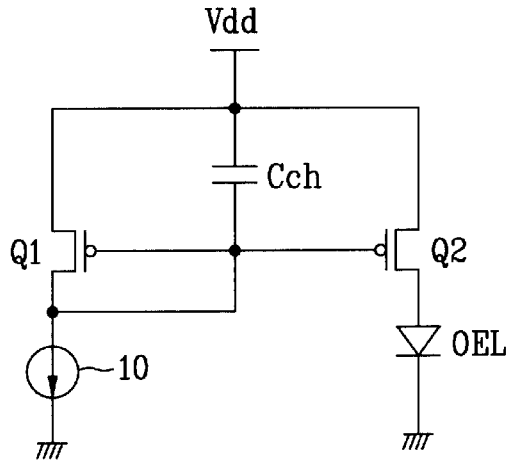
Figure 2D:
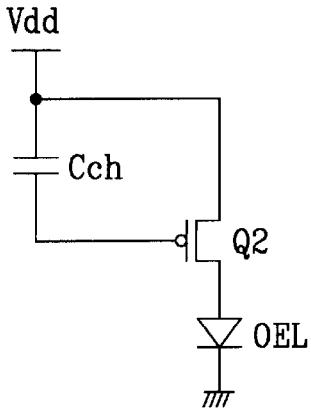
FIG. 2D is a diagram showing an active driving circuit when the third PMOS transistor and the fourth PMOS transistor of FIG. 2A are turned off.

FIG. 2B is a diagram showing the active driving circuit when a third PMOS transistor of FIG. 2A is turned on, FIG. 2C is a diagram showing the active driving circuit when the third PMOS transistor and a fourth PMOS transistor of FIG. 2A are turned on, and FIG. 2D is a diagram showing the active driving circuit when the third PMOS transistor and the fourth PMOS transistor of FIG. 2A are turned off.

The constant current source 10 controls a constant current Iset in accordance with the gray signal of the data line and supplies the controlled current to the common gate terminal 40 of the first and second PMOS transistors Q1 and Q2 having the mirror circuit to the first PMOS transistor Q1. Then, a constant voltage difference occurs in the common gate terminal 40. In other words, the voltage difference corresponding to the difference between the saturated gate threshold voltage and the gate threshold voltage of the controlled current occurs.

Meanwhile, if the first PMOS transistor Q3 is turned on by the low signal from the scan line, a positive current corresponding to the positive power source Vdd flows to the first PMOS transistor Q1. The first PMOS transistor Q1 is operated as a diode as shown in FIG. 2b. Accordingly, a value obtained by subtracting the source-gate voltage value Vgs of the first PMOS transistor Q1 from the voltage of the positive power source Vdd is applied to the common gate terminal 40 as the saturated gate threshold voltage.

Subsequently, following the third PMOS transistor Q3, if the fourth PMOS transistor Q4 is turned on by the scan line signal (low signal), as shown in FIG. 2C, the common gate terminal 40 is connected with the constant current source 10. The common gate threshold voltage of the common gate terminal 40 is varied in proportional to the controlled current of the constant current source 10. If the current value of the constant current source 10 is controlled, the saturated common gate terminal voltage becomes lower than the original level value by the controlled current. Accordingly, the common gate terminal voltage which controls the amount of the charges of the capacitor to set a desired gray signal is set by the circuit of FIG. 2C.

As described above, since the first and second PMOS transistors Q1 and Q2 constitute a mirror circuit, the voltage applied to the gate terminal of the first PMOS transistor Q1 becomes lower by the controlled current in the same manner as the voltage applied to the gate terminal of the second PMOS transistor Q2.

Meanwhile, since the control terminal of the first PMOS transistor Q1 is connected with the second signal terminal of the third PMOS transistor Q3, the first PMOS transistor Q1 is operated as the diode and the voltage of the common gate terminal 40 is uniformly maintained.

Thus, charges corresponding to the difference between the voltage of the common gate terminal 40 and the voltage of the positive power source Vdd are accumulated in the charge storage capacitor Cch. At this time, charges according to characteristic of the first and second PMOS transistors Q1 and Q2 are accumulated in the charge storage capacitor Cch.

On the other hand, if the signal applied from the scan line is transited to high state, the fourth PMOS transistor Q4 and the third PMOS transistor Q3 are turned off. At this time, the circuit of FIG. 2A is transited to the circuit of FIG. 2D. That is, only the second PMOS transistor Q2 and the charge storage capacitor Cch act on the driving of the OEL.

Therefore, the second PMOS transistor Q2 supplies a constant current to the OEL, and the OEL is light-emitted by the supplied current.

Finally, brightness of the OEL can uniformly be maintained because the second PMOS transistor Q2 has the same gate threshold voltage as that of the first PMOS transistor Q1. In other words, it is possible to prevent brightness change of the OEL resulting from different threshold voltages of 0.6 V~0.8 V.

Meanwhile, brightness (intensity of light) of the OEL can be controlled by controlling the size of the negative power source Vss connected with the cathode terminal of the OEL.

Other embodiments of the present invention will be described below.

The OEL may be an active matrix organic electroluminescence (AMOEL). The AMOEL is operated at a very low current level. Accordingly, the active driving circuit for a display panel according to the present invention is easy to control the AMOEL.

It is possible to control a ratio of the controlled current of the constant current source 10 to the current of the OEL by controlling a ratio of the width/length of the first and second PMOS transistors Q1 and Q2.

For example, when the ratio of width/length of the first PMOS transistor Q1 to the second PMOS transistor Q2 is set at 10:1, the size of the current of the OEL can be set at 1 nA if the controlled current of the constant current source 10 has a size of 10 nA. Alternatively, the width/length of the first PMOS transistor Q1 to the second PMOS transistor Q2 may be set at various ratios. In such case, a current ratio of the constant current source 10 to the OEL is varied depending on the width/length.

Figure 3:
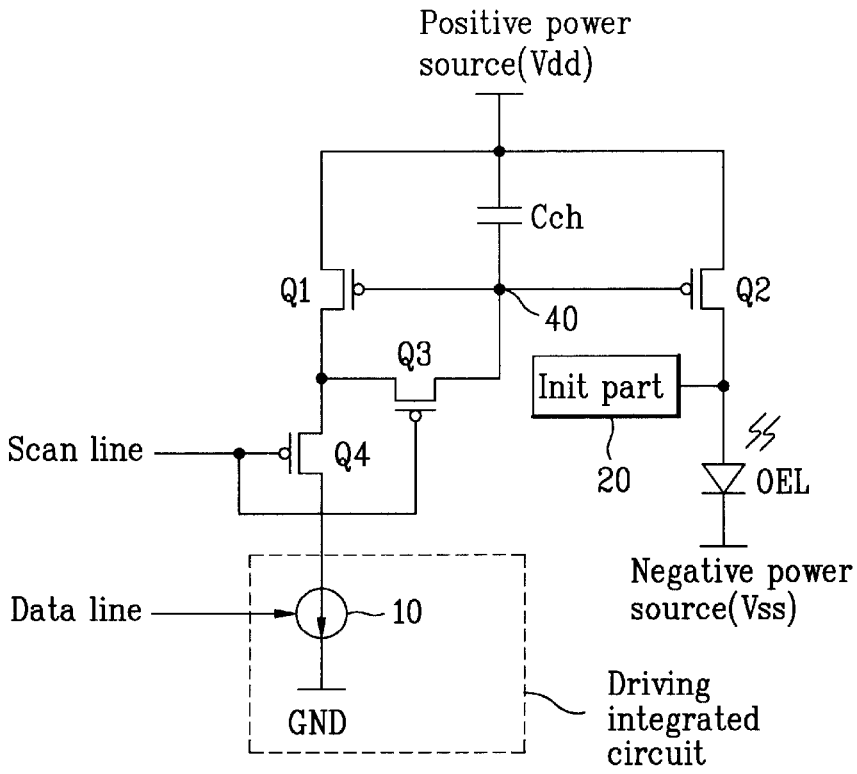
FIG. 3 is a circuit diagram showing a driving circuit based on four active devices according to the second embodiment of the present invention.

FIG. 3 is a circuit diagram showing the driving circuit based on four active devices according to the second embodiment of the present invention.

Referring to FIG. 3, to obtain fast response time of the OEL, an init 20 is additionally provided as another current supply source that initially supplies a constant current to the OEL. The init 20 can improve delayed response time when a very low current is used to drive the OEL.

Other elements except for the init 20 are equal to those of FIG. 2A and thus their detailed description will be omitted.

Figure 4:
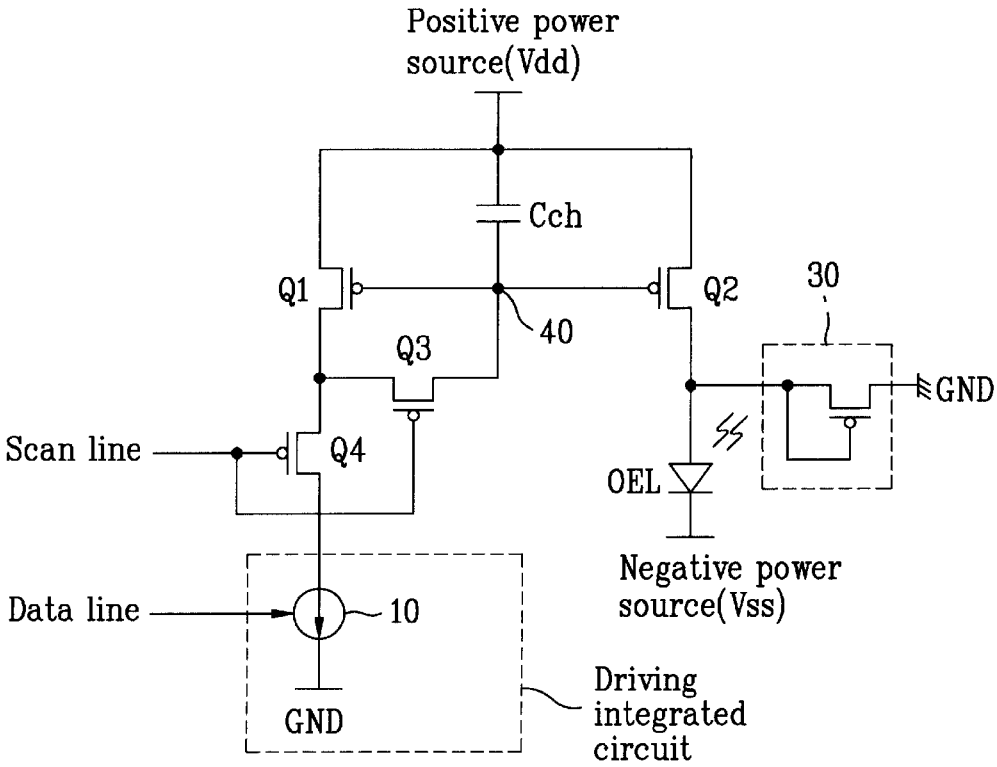
FIG. 4 is a circuit diagram showing a driving circuit based on four active devices according to the third embodiment of the present invention.

FIG. 4 is a circuit diagram showing the driving circuit based on four active devices according to the third embodiment of the present invention.

Referring to FIG. 4, a diode 30 for protecting a voltage is additionally provided at the anode of the OEL. The diode 30 is connected between the second PMOS transistor Q2 and the OEL in parallel.

When the negative power source Vss is lowered below a ground value, the diode 30 acts to prevent the anode of the OEL from being lowered below the ground value. Accordingly, voltage drop of the first PMOS transistor Q1 is avoided, and error operation of the second PMOS transistor Q2 is avoided.

As aforementioned, the active driving circuit for a display panel according to the present invention has the following advantages.

First, it is possible to control the amount of the current of the OEL with a digital signal. In other words, it is possible to easily control the amount of the current of the OEL for each unit of mode or current level.

Second, since luminance of the OEL is controlled using the current, it is possible to easily integrate the active driving circuit for the OEL.

Third, since the current is controlled by a programming mode, it is possible to easily control a very small current level when the OEL based on the current driving mode is driven.

Finally, it is possible to improve response and luminance characteristics of the OEL by initially applying the current to the OEL based on the current driving mode.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An active driving circuit for a display panel comprising:

a first transistor connected with a positive power source;

a second transistor having a common gate terminal together with the first transistor and a mirror circuit against the first transistor, turned on by a common gate signal applied to the common gate terminal to supply the positive power source to a display device;

a third transistor for setting a saturated threshold voltage for the common gate terminal by allowing the first transistor and the second transistor to constitute a mirror circuit against each other, when it is turned on by a scan line signal;

a constant current source for supplying a current with a ground one side and controlled by a gray signal of a data line;

a fourth transistor turned on by the scan line signal subsequent to the third transistor, for supplying the common gate voltage corresponding to the controlled current of the constant current source; and a capacitor for accumulating charges corresponding to the difference between the positive power source and the common gate voltage.

2. The active driving circuit for a display panel of claim 1, further comprising an init connected between the active driving circuit and the display device, for initially supplying a constant current to the display device.

3. The active driving circuit for a display panel of claim 1, further comprising a diode for protecting a voltage, which is connected between the active driving circuit and the display device to prevent an anode of the display device from being lowered below a constant voltage.

4. The active driving circuit for a display panel of claim 1, wherein the first to fourth transistors are PMOS or NMOS transistors.

5. The active driving circuit for a display panel of claim 1, further comprising a negative power source connected with a cathode of the display device, for controlling the intensity of light-emission of the display device.

6. The active driving circuit for a display panel of claim 1, wherein the display device is an active matrix organic electrodluminescence (AMOEL).

7. The active driving circuit for a display panel of claim 1, wherein a ratio of width/length of the first transistor to width/length of the second transistor is proportional to a ratio of a current supplied to the display device to the controlled current of the constant current source.

8. The active driving circuit for a display panel of claim 1, wherein the first transistor is not operated as the mirror circuit against the second transistor when the third transistor and the fourth transistor are turned off by the scan line signal.

9. The active driving circuit for a display panel of claim 1, wherein the constant current source is included in a driving integrated circuit.

* * * * *